US010441058B2

(12) United States Patent
Silva

(10) Patent No.: US 10,441,058 B2
(45) Date of Patent: Oct. 15, 2019

(54) COSMETIC BLOTTING TOOL AND CONTAINER SYSTEM AND METHOD

(71) Applicant: Rea.deeming Beauty, Inc., Bethlehem, PA (US)

(72) Inventor: Rea Ann Silva, Bethlehem, PA (US)

(73) Assignee: REA.DEEMING BEAUTY, INC, Bethlehem, PA (US)

( * ) Notice: Subject to any disclaimer, the term of this patent is extended or adjusted under 35 U.S.C. 154(b) by 563 days.

(21) Appl. No.: 15/056,941

(22) Filed: Feb. 29, 2016

(65) Prior Publication Data

US 2017/0143102 A1 May 25, 2017

Related U.S. Application Data

(63) Continuation of application No. 29/546,606, filed on Nov. 24, 2015, now Pat. No. Des. 800,961.

(51) Int. Cl.
*A45D 42/02* (2006.01)
*A47K 7/02* (2006.01)

(52) U.S. Cl.
CPC ..... *A45D 42/02* (2013.01); *A47K 7/02* (2013.01); *A45D 2200/1009* (2013.01)

(58) Field of Classification Search
CPC ..... A45D 42/02; A45D 2200/1009; A45D 2200/10; A45D 2200/1027; A47K 7/02
USPC ..... 132/320
See application file for complete search history.

(56) References Cited

U.S. PATENT DOCUMENTS 3,472,242 A * 10/1969 Demner ..... A45D 40/00 132/333
4,053,242 A * 10/1977 Mast, Jr. ..... A45D 33/00 15/104.94
5,771,524 A 6/1998 Woods et al.
5,904,151 A * 5/1999 Gueret ..... A45D 40/00 132/293
5,913,318 A 6/1999 Gueret
6,013,344 A 1/2000 Corbins
6,214,362 B1 4/2001 Page
6,601,591 B1 8/2003 Carullo et al.
6,645,611 B2 * 11/2003 Seth ..... B32B 5/18 428/311.11
6,684,888 B1 2/2004 Seabury
(Continued)

FOREIGN PATENT DOCUMENTS

JP 2001095620 A 4/2011

OTHER PUBLICATIONS

International Search Report and Written Opinion for U.S. Appl. No. PCT/US16/20120 dated Jun. 2, 2016.

*Primary Examiner* — Rachel R Steitz

(74) *Attorney, Agent, or Firm* — Brooks Acordia IP Law, P.C.; Pejman Yedidsion

(57) ABSTRACT

Methods, devices, and systems of cosmetic blotting tool and container, where a folium shaped sponge may be made of foam material and further comprise an oil absorbent characteristic to remove excess oils from a skin surface without disrupting previously applied cosmetics. Additionally, the cosmetic blotting tool and container may include a storage housing comprising a removable lid member and a vented base member, where the vented base member may facilitate drying of the first folium shaped sponge after usage via providing a ventilated area, and where the storage housing may be configured to receive and store the folium shaped sponge.

12 Claims, 10 Drawing Sheets

(56) References Cited

U.S. PATENT DOCUMENTS

| | | | | |
|---|---|---|---|---|
| 7,214,336 | B2 | 5/2007 | Sheridan et al. | |
| 8,393,043 | B2 | 3/2013 | Limongi et al. | |
| 8,584,686 | B2 | 11/2013 | Polanish | |
| 8,914,936 | B2 | 12/2014 | Jemsby et al. | |
| 8,973,754 | B2 * | 3/2015 | Ahmed | A46B 5/0041 132/321 |
| 9,010,342 | B2 | 4/2015 | Orr | |
| 9,125,528 | B2 | 9/2015 | Boon et al. | |
| 2001/0017141 | A1 | 8/2001 | Gueret | |
| 2002/0013108 | A1 | 1/2002 | Dobler | |
| 2006/0000043 | A1 * | 1/2006 | Jou-Chen | A47L 13/16 15/231 |
| 2009/0151748 | A1 | 6/2009 | Ridenhour | |
| 2015/0265028 | A1 | 9/2015 | Wilson | |

* cited by examiner

COSMETIC BLOTTING TOOL AND CONTAINER SYSTEM AND METHOD

CROSS-REFERENCE TO RELATED APPLICATIONS

This application claims priority to and benefit of Design Patent Application No. 29/546,606 filed Nov. 24, 2015 and is hereby incorporated by reference for all purposes.

TECHNICAL FIELD

The invention in its several embodiments relates to the field of cosmetic blotting and more particularly to devices and methods for a blotting sponge having a characteristic to absorb excess oil without disturbing makeup.

SUMMARY

A device embodiment of the cosmetic blotting tool system may comprise: a first folium shaped sponge where the first folium shaped sponge may be made of foam material, and where the first folium shaped sponge may comprise an oil absorbent characteristic to remove excess oils from a skin surface without disrupting previously applied cosmetics; and a storage housing comprising a removable lid member and a vented base member, where the vented base member may facilitate drying of the first folium shaped sponge after usage via providing a ventilated area, and where the storage housing may be configured to receive and store the first folium shaped sponge. The device embodiment of the cosmetic blotting tool system may further comprise a second folium shaped sponge where the second folium shaped sponge may also be made of foam material, and where the second folium shaped sponge may comprise an oil absorbent characteristic to remove excess oils from a skin surface without disrupting previously applied cosmetics.

Additionally, the storage housing may be further configured to receive and store the second folium shaped sponge and the device may further comprise a separator member configured to be placed between the first folium shaped sponge and the second folium shaped sponge, where the separator member may be dimensioned to be inserted in the storage housing in a manner to fully space the first folium shaped sponge from the second folium shaped sponge. Optionally, the separator member may be constructed from transparent material and the removable lid member may be detachably attached to the base member where the removable lid member may be detachably attached to the base member via hinges. In another embodiment, the removable lid member may comprise a reflective surface for reflecting a clear image.

In other embodiment of the device the base member may comprise an inner wall and an outer wall, where the inner wall may comprise a pair of concave shaped areas to fit a fingertip along an inner channel of the inner wall to lift the first folium shaped sponge. In addition, the first folium shaped sponge and the second folium shaped sponge may be made of non-latex foam material where the first folium shaped sponge and the second folium shaped sponge, made of non-latex foam material, each may comprise anti-microbial agents thereby inhibiting growth of bacteria inside both the first folium shaped sponge and the second folium shaped sponge.

The device embodiment of the cosmetic blotting tool system may be where the first folium shaped sponge and the second folium shaped sponge each comprise a range of angles for application of the folium shaped sponge based on a contact angle between the folium shaped sponge and the skin surface. Additionally, the first folium shaped sponge and the second folium shaped sponge may each be configured to: remove the excess oil through a pressing and lifting motion on the skin surface; and smooth out any remaining cosmetics on the skin surface via a pressing motion following the removal of excess oil via the pressing and lifting motion.

Method embodiments of the cosmetic blotting tool may comprise the steps of: providing a folium shaped sponge for absorbing excess oil substances from a skin surface; removing the excess oil substances from the skin surface via the folium shaped sponge being comprised of foam material and through a pressing and lifting motion on the skin surface, where the folium shaped sponge comprises an oil absorbent characteristic to remove excess oils from the skin surface without disrupting previously applied cosmetics; smoothing out any remaining cosmetics on the skin surface via a pressing motion following the pressing and lifting motion, where the any remaining cosmetics is from a previously applied cosmetics; and improving appearance of cosmetics on the skin surface based on the removing of the excess oil substances and the smoothing out any remaining cosmetics on the skin surface.

Additionally, the method may further comprise the step of reusing the folium shaped sponge subsequent to washing the folium shaped sponge and allowing it to dry and storing the folium shaped sponge in a storage housing, the storage housing comprising a removable lid member and a vented base member. Further, the method may comprise placing a separator member between a plurality of folium shaped sponges that are being stored in the storage housing where the separator member may be a hygienic separator. In addition, the method may comprise the step of: determining a set range of angles for applying the folium shaped sponge based on a contact angle between the folium shaped sponge and the skin surface; and adjusting placement of different corners of the folium shaped sponge against the skin surface via rotating the folium shaped sponge.

BRIEF DESCRIPTION OF THE DRAWINGS

Embodiments are illustrated by way of example and not limitation in the figures of the accompanying drawings, and in which.

BACKGROUND

Figure 1:
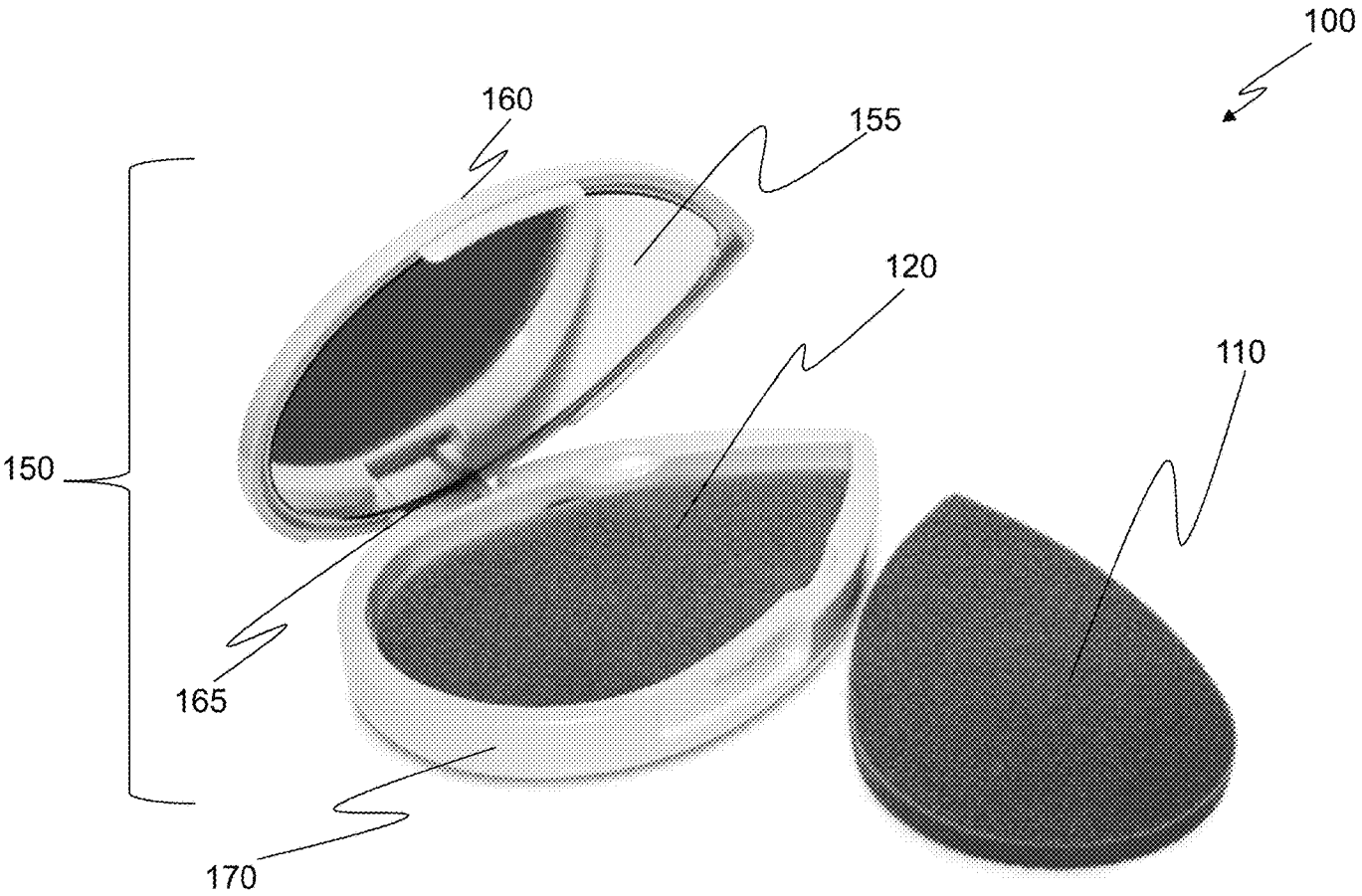
FIG. 1 depicts an exemplary embodiment of the cosmetic blotting tool system which may comprise a containing member and two folium shaped sponges.

After a person has applied cosmetics, for example, makeup, foundation, powder, mascara, blush, lipstick, and/or eye shadow, it is desirous that the original look of the applied cosmetics on their skin is maintained. However, many users of cosmetics have skin which produces oils that may be above a desired threshold and affect the look and feel of the cosmetic they have already applied. Naturally, a person's skin, via the oil glands, will continue to produce oil and accordingly, the person would desire to remove some of the excess oil without disturbing the cosmetic already applied.

One solution has been that individuals typically use thin, disposable tissues or blotting paper and powders to remove the excess oil periodically throughout the day. Typically, the thin disposable tissue paper is a rice paper type of material. However, these oil absorbent papers are often irritating to the skin due to the hard and stiff nature of the fibers. Attempts have been made to improve their smoothness; at the risk of decreasing their oil absorption capability. Additionally, thin paper blotters do not conform to the curvature of a human face and make it extremely difficult to reach certain spaces.

DETAILED DESCRIPTION

A cosmetic blotting tool system may comprise porous material, for example, a sponge, having the capacity to remove oils produced by the sebaceous glands which are microscopic exocrine glands in the skin that secrete an oily or waxy matter. Human skin produces such oils to lubricate the skin and hair and the glands are found in the greatest number on the face and scalp. Once applied, cosmetic makeup is used to enhance the appearance of the human body, especially the facial area, and is generally made up of mixtures of chemical compounds. In one embodiment of the cosmetic blotting tool system, the sponge may be used to dry a wet surface, i.e., oily skin areas, via using the absorbent material characteristics of the sponge. That is, the sponge of the cosmetic blotting tool would effectively absorb the oils on the skin through the cosmetic makeup without disrupting or spoiling the cosmetic makeup that has already been applied to the skin. The sponge of the blotting tool may be made up of consistent material in order to provide a soft touch to the skin and possess highly absorbent characteristics.

Additionally, the blotting sponge may be used for replacing or rearranging already applied makeup by the user, when placing the blotter material on the skin. That is, the blotting sponge may be used in a manner in which it may smooth out existing makeup via a motion comprising: a pressing and lifting motion that may then lift excess oils while pressing the blotter on to the skin surface, e.g., the face, which smoothes and rearranges existing makeup after exposure to excess oil that causes makeup separation. Accordingly, the blotting sponge may serve multiple purposes where it may simultaneously effect the removing of oils on the skin while not disturbing the already applied makeup, and smoothing out any separations caused in the existing makeup.

In some embodiments, the sponge, having a porous structure, for example, a porous medium or a porous material, may be used to enhance the ability to not only soak the oil but also hold it without allowing it to spill out. In an embodiment where the sponge may be made of material that is uniform throughout, the sponge facilities blotting of the skin in order to help control oil and minimize shine. In one embodiment, the sponge may be made of material containing pores or voids, providing the ability to retain the oil without allowing it to escape and get on the hand or unwanted surfaces. Accordingly, the sponge of the cosmetic blotting tool system may be oil absorbing, such that the sponge removes facial oil, where the sponge is soft, conformable, and non-abrasive to the skin.

In one embodiment of the cosmetic blotting tool system, the sponge may be shaped in a way so as to provide ease of use and ability to hold and apply the blotter. Accordingly, the sponge may be in the shape of a folium or a teardrop shape which may look like an oval with one end pointed outward. The sponge may be completely convex, or it may become concave as it nears the point or tip. A completely convex teardrop shape may be called a folium. That is, the sponge may be shaped to fit all contours of the face, and not leave unused corners in those areas of the face that are hard to reach. Additionally, the sponge of the cosmetic blotting tool system is flexible, i.e., capable of bending easily without breaking, to provide reachability based on the curves and contours of the face. For example, by placing the prominent bottom half of the sponge gently against larger areas of the face, i.e., T-zone, cheeks, or chin, the cosmetic blotting tool system may absorb shine and maintain a flawless finish on existing makeup. Additionally, and as another example, by placing the fine pointed half of the sponge gently against small curves and corners of the face, i.e., the temples and under the eyes, the hard to reach areas may be effectively blotted so as to remove oils from those areas while keeping the makeup intact. In one embodiment, by absorbing excess oil without disturbing makeup, the skin stays looking radiant. Accordingly, using the folium and/or teardrop shape for applying to the face the sponge is ideal for effortlessly reaching every nook and corner of the face while imparting a matte finish on the skin.

Embodiments of the cosmetic blotting tool system utilize a sponge having washable qualities which may then be reused after washing it with liquid. The sponge may then be allowed to dry fully to have the most effective absorbent qualities so as to absorb unwanted shine produced because of the oils. Since the sponge of the cosmetic blotting tool system is reusable, the system provides for a plastic type separator to be placed between multiple sponges in order to hygienically separate and store the sponge blotters. In one embodiment of the cosmetic blotting tool system, the sponge may be cleansed with a special cleanser and dried in a well-ventilated area. By using the hygienic separator, the system provides for the freshness of the sponges and cleanliness together and simultaneously.

Embodiments of the cosmetic blotting tool system comprise a storage housing for storing the folium shaped sponges, and may be shaped similarly to the sponges. The storage housing may be a volume-enclosing container for storage. The storage housing may comprise a removable and/or adjustable lid member that may be detachably attached via one or more hinges to a base member. The system may also comprise a vented base member, where the vented base member may facilitate drying of the folium shaped sponge after usage, via providing a ventilated area. Accordingly, in one embodiment of the cosmetic blotting tool system, a plurality of sponges may be placed inside the storage housing via placing a separator between each sponge, while allowing air ventilation through the vented base member to dry the sponges that may have been used to remove oils from the skin—ensuring that the sponges keep their freshness and are hygienically separated.

FIG. 1 depicts an exemplary embodiment of the cosmetic blotting tool system 100 which may comprise a containing member, i.e., storage housing 150 and two folium shaped sponges 110, 120 for oil removal without tampering existing makeup on the skin. This embodiment may also comprise a reflective surface, e.g., a mirror 155, placed on the inside of a removable and/or adjustable lid member 160 that may be detachably attached via one or more hinges 165 to a base member 170, thereby making it a mirrored compact. The figure shows two folium shaped sponges 110, 120, with one sponge 120 still inside the storage housing 150 and one sponge 110 outside the storage housing. As described herein, the folium shaped sponges 110, 120 may be reusable, where after the sponge has been used to remove oils, the sponge may be washed and allowed to dry. The sponge may then regain its original form and be ready for use again after drying. As depicted, the storage housing 150 may also be in the folium shape of the sponge to accommodate the storage of the sponges 110, 120 inside the housing. Additionally, the storage housing 150 may comprise a base member 170 having a vented back with ventilation openings so as to allow air to travel inside the storage housing 150 and help facilitate drying of the sponges 110, 120.

Figure 2:
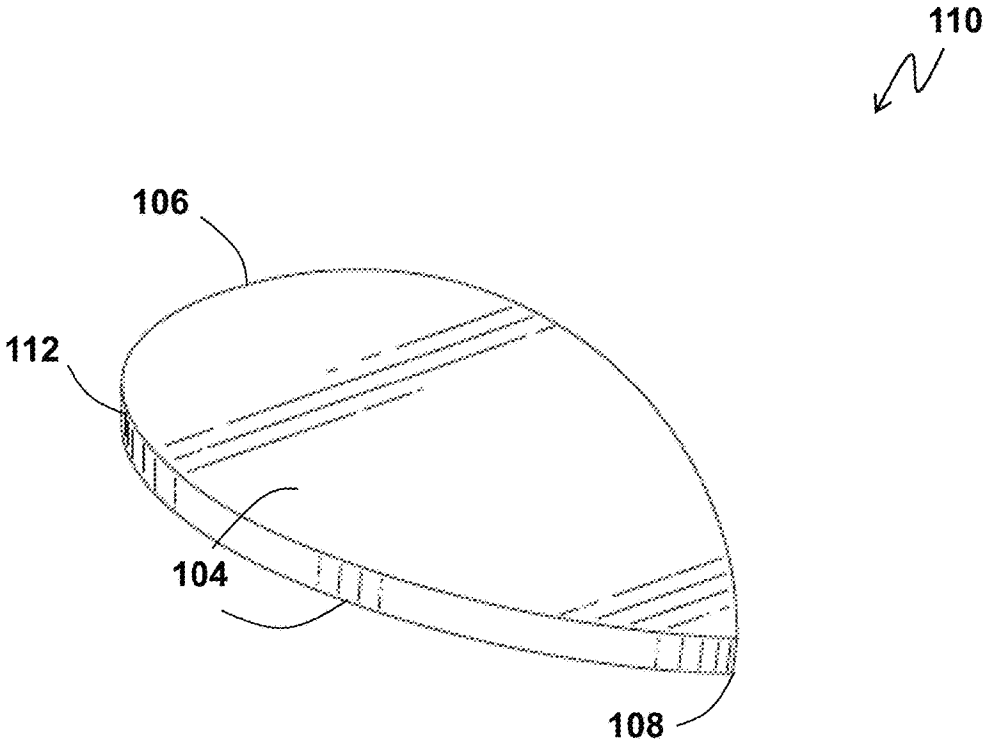
FIG. 2 depicts, in a perspective view, an exemplary sponge of the cosmetic blotting tool system.

FIG. 2 depicts, in a perspective view, an example of a sponge 110 of the cosmetic blotting tool system. The sponge 110 is shown as having a thickness 112—creating a volume between two surfaces 104—comprising non-latex foam material with anti-microbial agents. In an embodiment where the sponge may comprise a non-latex, anti-microbial material, the material may in effect inhibit the growth of bacteria inside the sponge. The sponge 110 may comprise an open-cell foam material where gas pockets may connect with each other and allow oil molecules to easily flow through the entire structure, displacing the air/gas pockets. The sponge 110 may also be folium shaped so as to offer different surface areas for usage on the skin and precision for absorbing oils from different target areas on the skin. The folium shaped sponge 110 is adapted to adjust to the curvatures of each human face based on how the user holds the sponge 110 and which area of the sponge 110 is applied to the skin. On one end of the example sponge 110, the pointed corner 108 may allow for application to narrower and tapered areas, for example, near the eyes, without over reaching and without removing oils from unwanted areas. The pointed corner 108 may additionally be used to remove a lower amount of oil since there is less absorbable area for the oil. On another end, the oval shape curve 106 may be used for covering larger surface areas, for example, near the cheeks, and with one end held in place, be used to remove larger amounts of oils from the skin. Accordingly, the shape of the sponge enables control of the amount of oil removed by providing different areas in each corner that can serve for oil removal purposes. Additionally, the sponge 110, having a volume, allows for the washable characteristic to be used in order to reuse the sponge.

Figure 3:
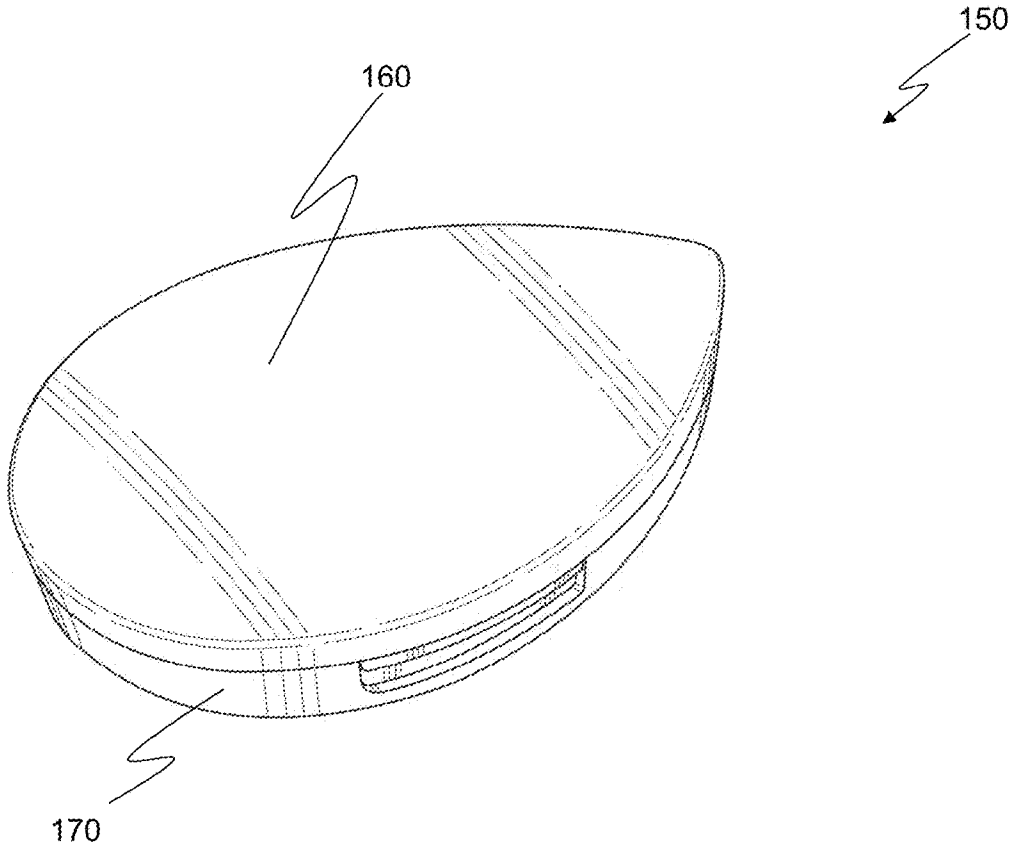
FIG. 3 depicts an exemplary embodiment of the storage housing of the cosmetic blotting tool system in a closed position.

FIG. 3 depicts an embodiment of the storage housing 150 of the cosmetic blotting tool system in a closed position. The storage housing 150 may comprise a removable and/or adjustable lid member 160 that may be detachably attached via one or more hinges (see 165 in FIG. 1) to a base member 170. The storage housing 150 may also have a mechanism for positioning and holding the removable and/or adjustable lid member 160 in relation to the base member 170, in a manner such that the removable and/or adjustable lid member 160 may be released by force applied to one of the parts, i.e., causing the removable and/or adjustable lid member 160 to pop open. The storage housing 150 may employ a clamping mechanism, a latching mechanism, or other mechanisms for coupling together the removable and/or adjustable lid member 160 to the base member 170.

Figure 4:
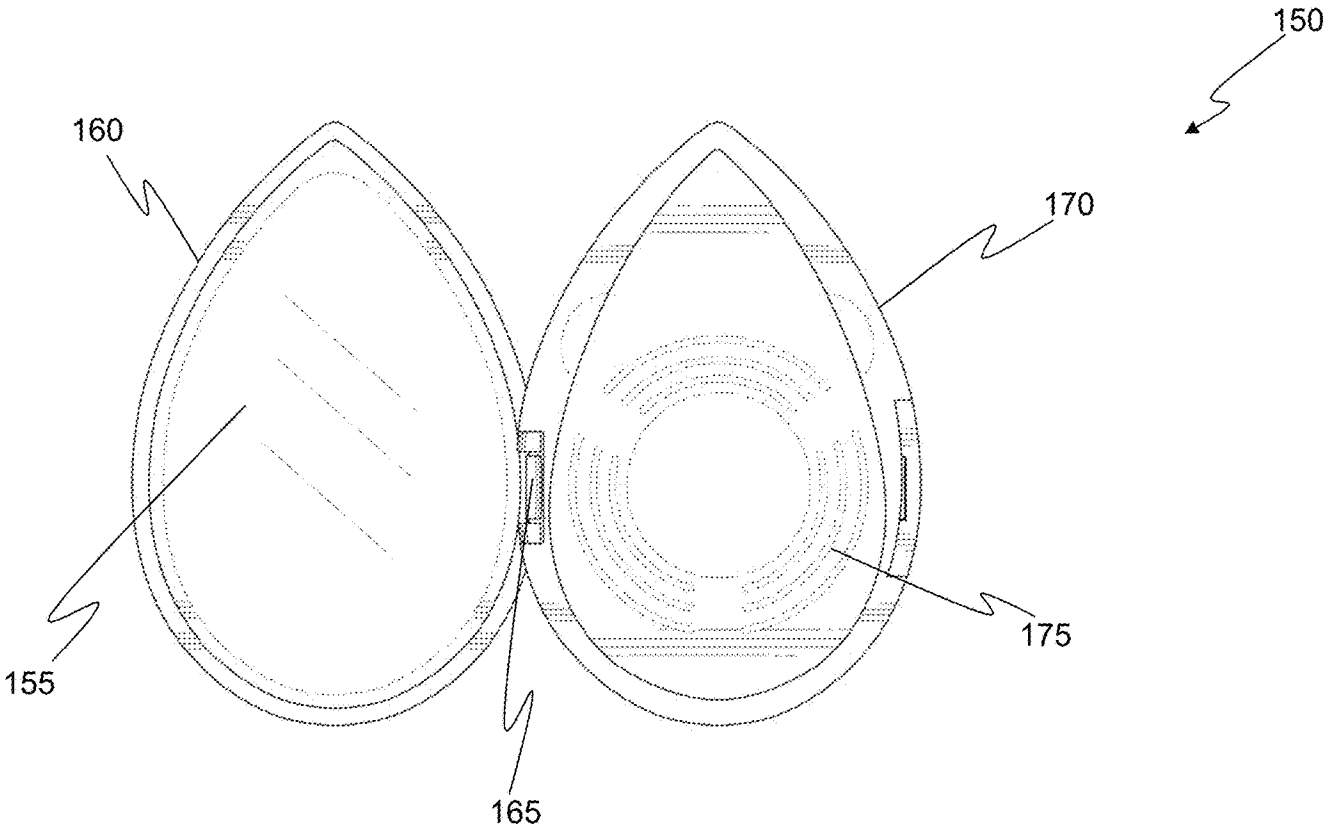
FIG. 4 depicts an exemplary embodiment of the storage housing of the cosmetic blotting tool system in an open position.

FIG. 4 depicts an exemplary embodiment of the storage housing 150 of the cosmetic blotting tool system in an open position. The storage housing 150 may comprise a removable and/or adjustable lid member 160 that may be detachably attached via one or more hinges 165 to the base member 170. The storage housing 150 may also have a mechanism for positioning and holding the removable and/or adjustable lid member 160 in relation to the base member 170 in a manner such that the removable and/or adjustable lid member 160 may be released by force being applied to one of the parts, i.e., causing the removable and/or adjustable lid member 160 to pop open. The storage housing 150 may have the base member 170 be detachably attached to the removable and/or adjustable lid member 160. When in the open position the removable and/or adjustable lid member 160 may house a mirror 155 to allow a user to see themselves while applying the sponge to remove the oils on their skin. The base member 170 is depicted as having a ventilated back 175, for example, in circular apertures and/or cavities. In some embodiments, the ventilated back 175 may comprise two or more concentric circular apertures and/or arcs. The ventilated back 175 allows for air flow to accelerate the drying of the sponge should it have been recently used, if the sponge is wet, and/or if the sponge contains oils removed from the skin.

Figure 5:
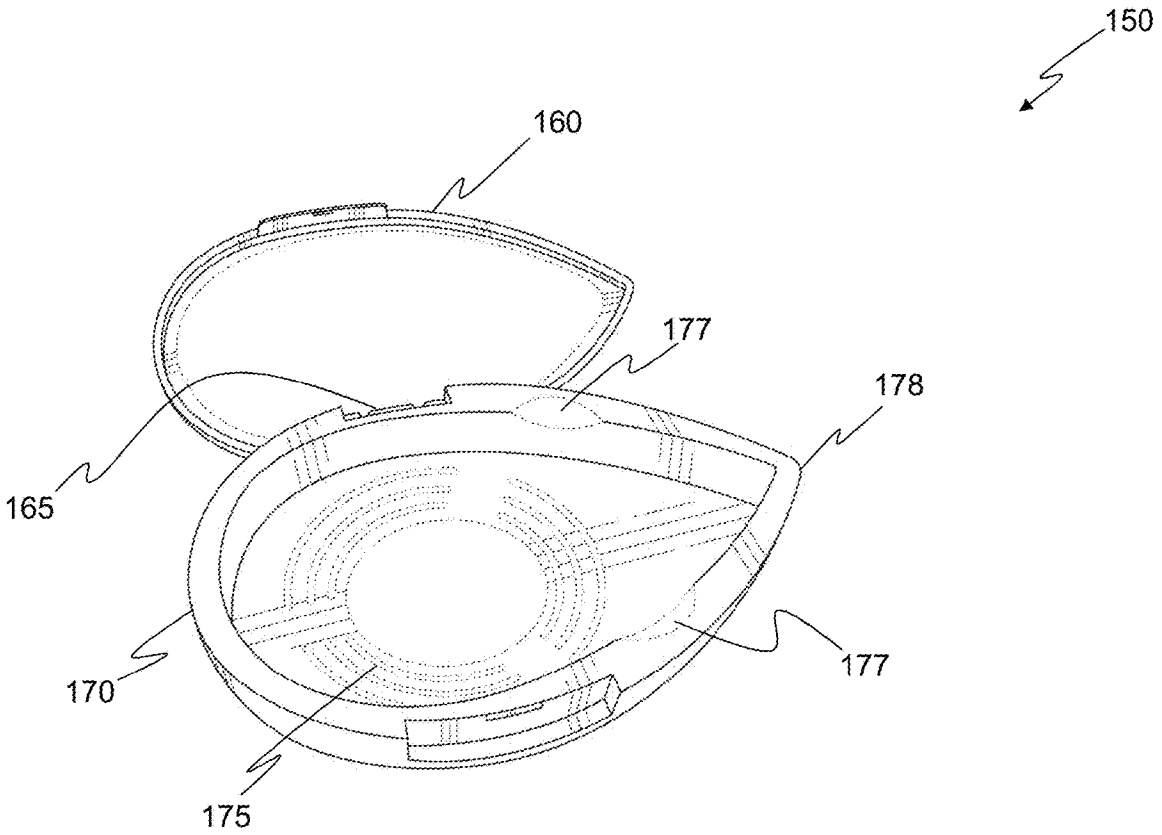
FIG. 5 depicts in a perspective view, an exemplary embodiment of the storage housing of the cosmetic blotting tool system in an open position.

FIG. 5 depicts in a perspective view, an example embodiment of the storage housing 150 of the cosmetic blotting tool system in an open position. The storage housing 150 may comprise a removable and/or adjustable lid member 160 that may be detachably attached via one or more hinges 165 to the base member 170. The base member 170 is depicted as having a ventilated back 175, for example, in circular apertures and/or cavities. The ventilated back 175 allows for air flow to accelerate the drying of the sponge should it have been recently used, if the sponge is wet, and/or if the sponge contains oils removed from the skin. Additionally, the base member 170 may comprise one or more concavities or cutout portions 177 along the inner walls, which may be converse from each other on opposing ends, so as to allow access to the sponges while retaining a tight fit of the sponges in the base member 170, and for them to be easily accessed. The concavity or cutout portion 177 may be embodied as a dimple on the inner walls of base member 170 and be arcuate shaped in a way so as to fit a fingertip along an inner channel to lift the sponge from one, or both, sides. The parabolic nature of the concavity or cutout portion 177 may run along the inner walls closer to the pointed corner 178 (also see 108, FIG. 2).

Figure 6:
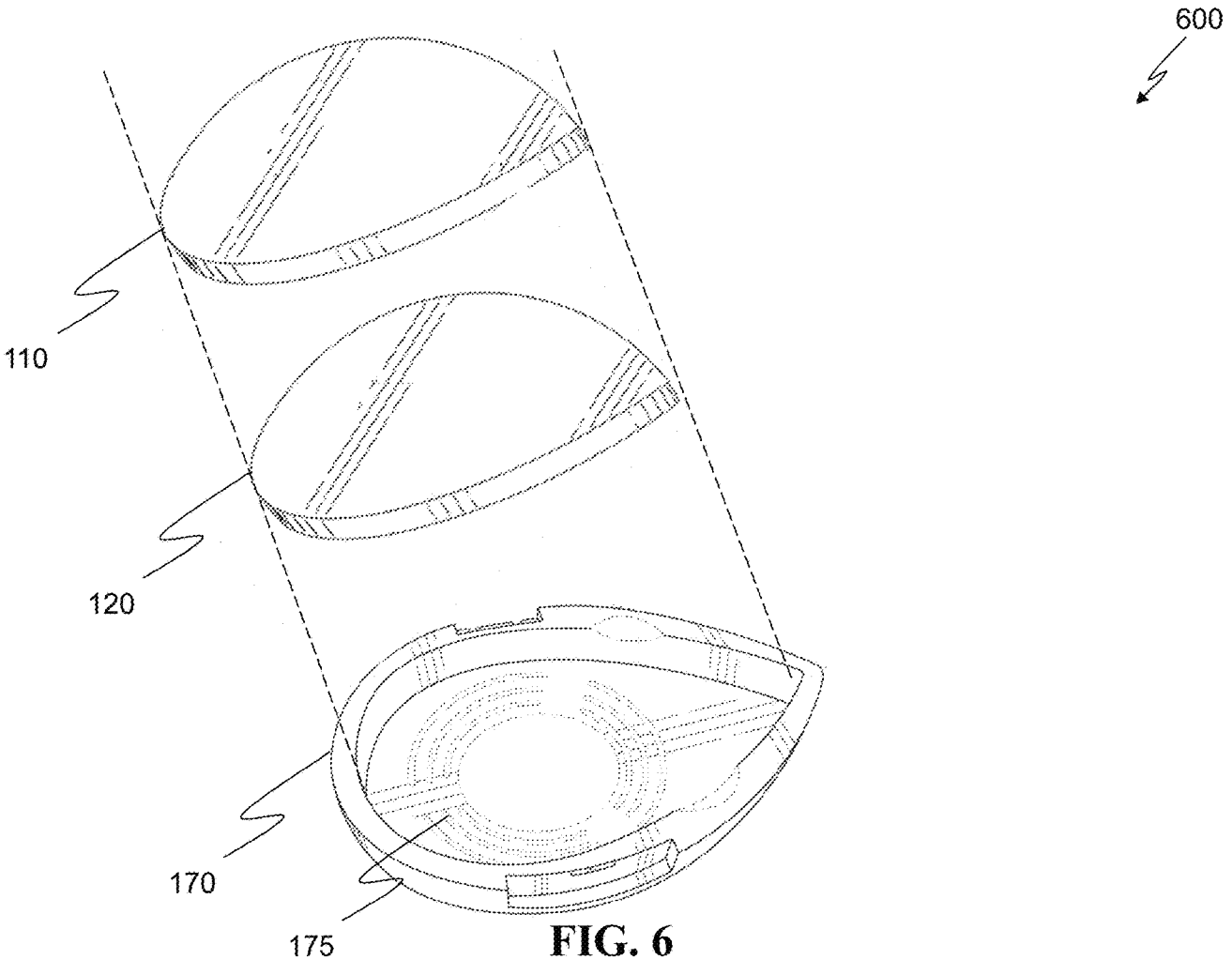
FIG. 6 depicts, in an exploded view, an exemplary cosmetic blotting tool system comprising a base member and two reusable sponges.

FIG. 6 depicts, in an exploded view, an exemplary example of a cosmetic blotting tool system 600 comprising a base member 170 and two reusable sponges 110, 120. The figure shows how the folium shaped sponges may lay on top of each other—separated via a separator sheet—and fit flush against a top surface of the base member 170 while in the base member 170. The base member 170 is also depicted as being in the shape of a folium, having a ventilated back 175 which allows for air flow to accelerate the drying of the sponge should it have been recently used. The cosmetic blotting tool system 600 may allow the sponges to, even if they are wet or contain oils removed from the skin, be stored in a sanitary manner. The figure depicts the washable sponges, as a reusable blotting device which allows for precise, cushion blotting. The blotting sponges 110, 120 are shaped to fit all the contours of the face and then offer a storage housing for immediate storage after use. The storage housing 150 (see 160, FIG. 1), stores the sponges in a manner which provides immediate access to the top sponge 110 or bottom sponge 120 depending on the desire of the user. Accordingly, the vented back 175 and storage arrangement, combined with a clear, hygienic separator, ensures sponge freshness even if needed for consecutive uses that may be instantaneous in time.

Figure 7:
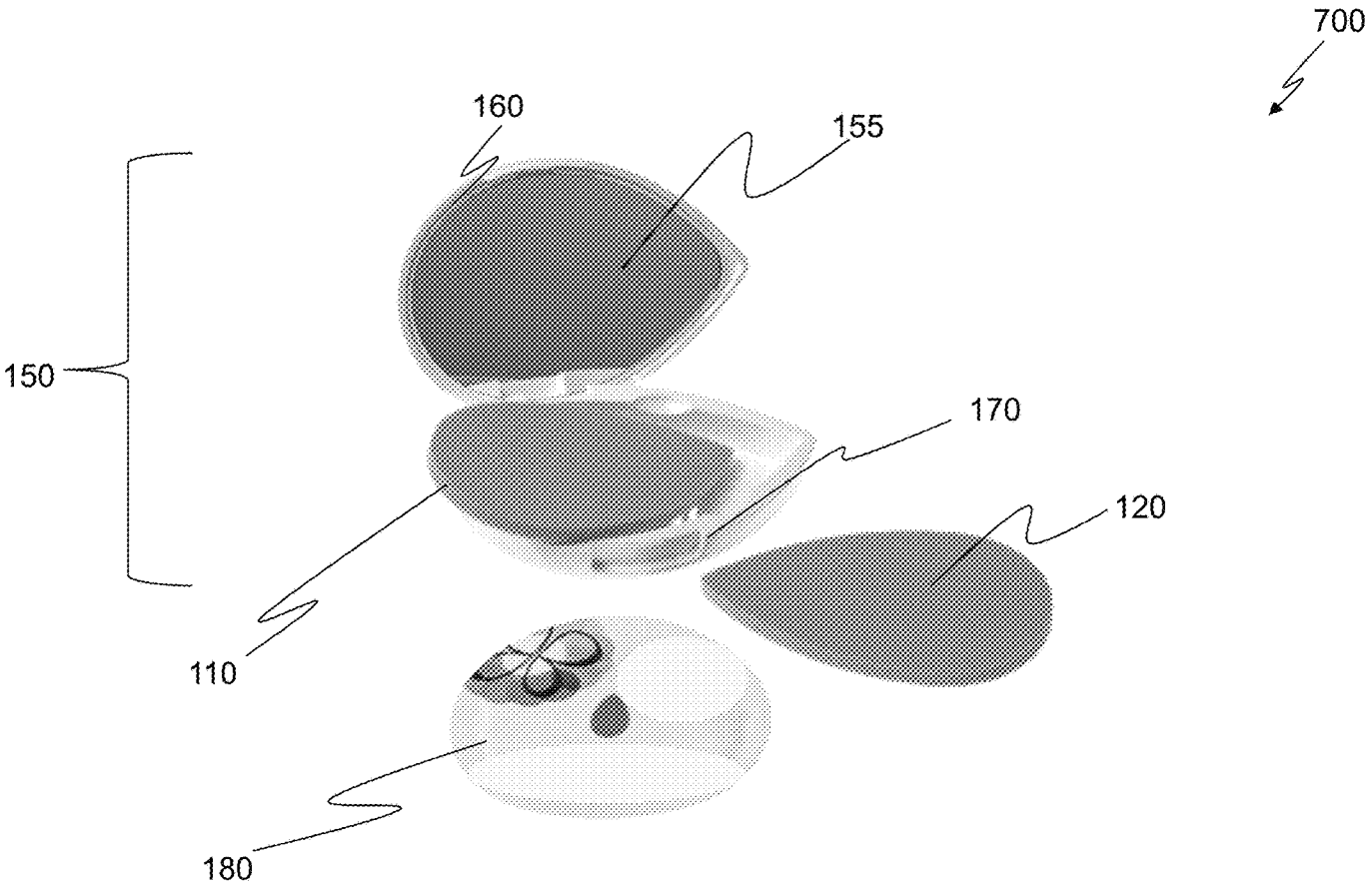
FIG. 7 depicts an exemplary cosmetic blotting tool system comprising: two reusable sponges; a storage housing which may comprise: a base member, and a lid member, and where the lid member may comprise a mirror, a plastic sheet separator, and a cleanser liquid contained in a storage bladder.

FIG. 7 depicts an exemplary cosmetic blotting tool system 700 comprising two reusable sponges 110, 120; a storage housing 150 which may comprise: a base member 170 with ventilation openings, a lid member 160 that may be detachably attached via hinges to the base member 170, and where the lid member 160 may comprise a mirror 155; a plastic sheet separator to separate both the sponges 110, 120 that may be placed inside the storage housing 150, and a cleanser liquid contained in a storage bladder 180. The cleanser liquid may be used to soak out tough stains and keep the sponges clean. The cleanser liquid contained inside the storage bladder 180 may be distributed onto the surface of the sponges and worked into a lather after being squeezed.

Embodiments of the cosmetic blotting tool system comprise sponges having an ability to lift and absorb excess oil from the skin without disturbing makeup thereby leaving the skin with a radiant look. The absorptive characteristics of the sponges may depend on the duration of contact with the skin and makeup and further, the physical condition of the skin. The absorption may also depend on the part of the body it is being applied to, including the amount of hair on the skin, and molecular weight of the oil molecules. The concentration of the makeup and oil may also affect the absorptive effect of the sponge.

Figure 8:
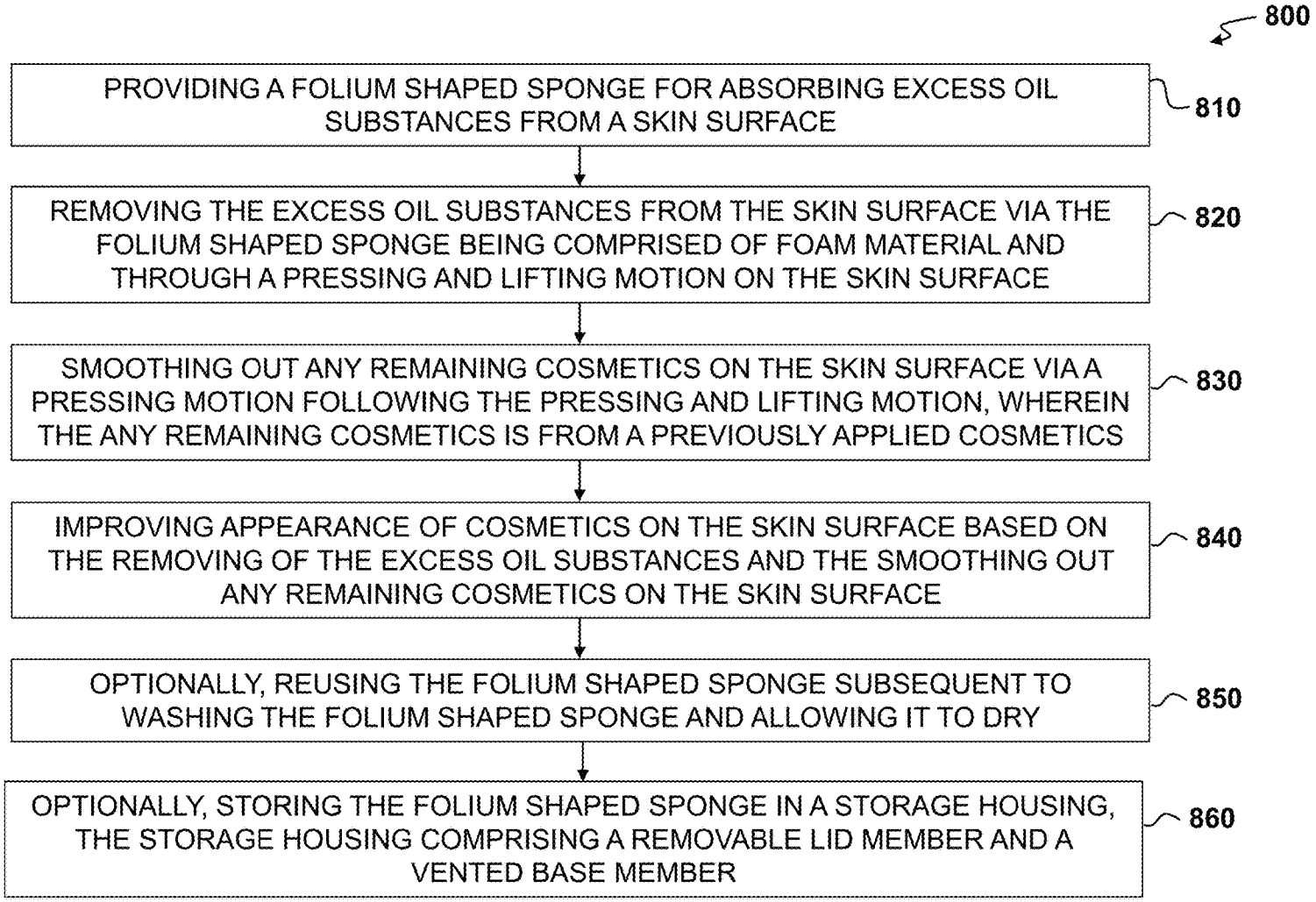
FIG. 8 depicts an exemplary flowchart for using the cosmetic blotting tool system.

FIG. 8 depicts an exemplary flowchart for using the cosmetic blotting tool system, and more specifically, for applying the blotter sponge to the skin surface. According to this exemplary method embodiment, the folium shaped blotting sponge may be use in the following steps: providing a folium shaped sponge for absorbing excess oil substances from a skin surface (step 810); removing, by the folium shaped sponge, the excess oil substances from the skin surface via the folium shaped sponge being comprised of foam material and through a pressing and lifting motion on the skin surface (step 820); smoothing out, by the folium shaped sponge, any remaining cosmetics on the skin surface via a pressing motion following the previously performed pressing and lifting motion, where the any remaining cosmetics may be from a previously applied cosmetics (step 830); and improving appearance of cosmetics on the skin surface based on the removing of the excess oil substances and the smoothing out any remaining cosmetics on the skin surface by the folium shaped sponge (step 840). Optionally, reusing the folium shaped sponge subsequent to washing the folium shaped sponge and allowing it to dry (step 850); and storing the folium shaped sponge in a storage housing, the storage housing comprising a removable lid member and a vented base member (step 860). Additionally, placing a separator member between a plurality of folium shaped sponges being stored in the storage housing may be used.

Figure 9:
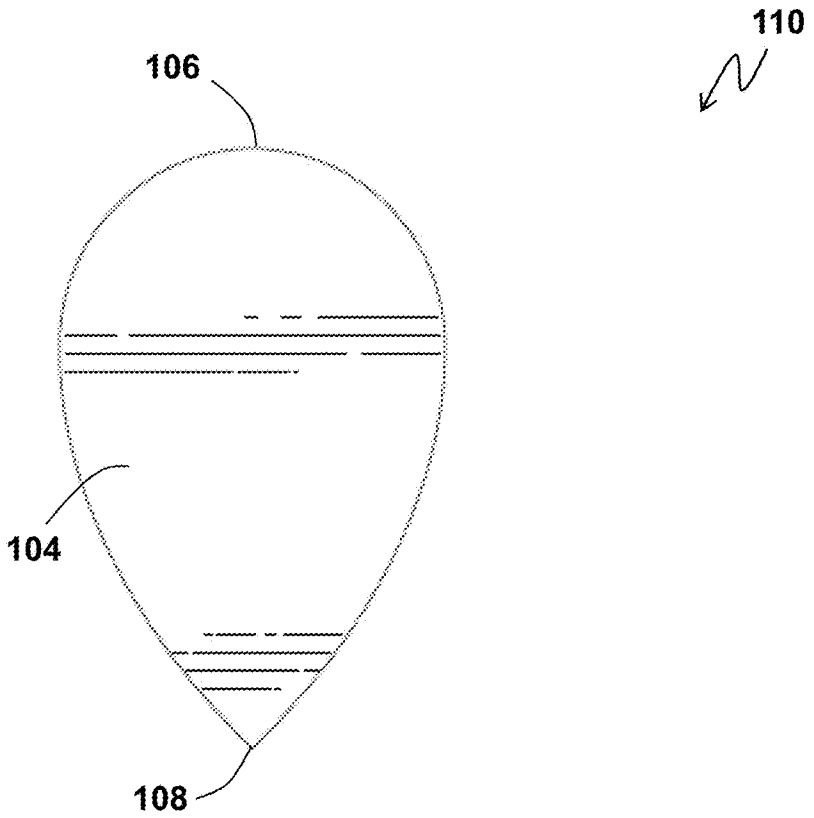
FIG. 9 depicts an exemplary front elevational view of the folium shaped sponge.
Figure 10C:
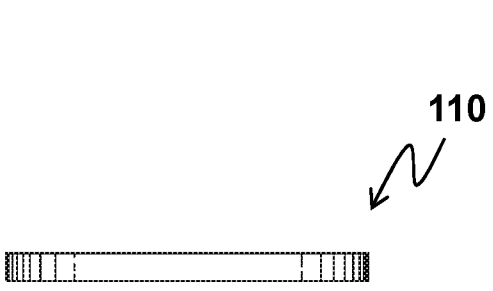
FIG. 10C depicts a bottom plan view of the exemplary folium shaped sponge.
Figure 10D:
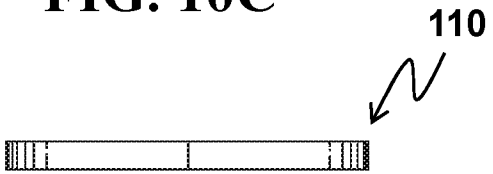
FIG. 10D depicts a top plan view of the exemplary folium shaped sponge.
Figure 10B:
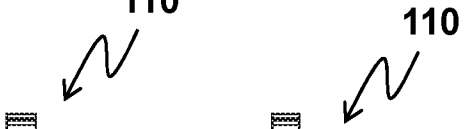
FIG. 10B depicts a right side elevational view of the exemplary folium shaped sponge.
Figure 10A:
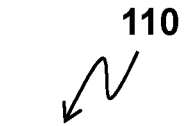
FIG. 10A depicts a left side elevational view of the exemplary folium shaped sponge.

FIG. 9 depicts an exemplary front elevational view of the sponge 110 having a top surface 104. The sponge 110 may be folium shaped so as to offer different surface areas for usage on the skin and precision for absorbing oils from different target areas on the skin. As in FIG. 2, on one end of the exemplary sponge 110, the pointed corner 108 may allow for application to narrower and tapered areas without over reaching and without removing oils from unwanted areas. The pointed corner 108 may be used to remove a lower amount of oil since there is less absorbable area for the oil. On the other end, the oval shape curve 106 may form a surrounding area that may be used for covering larger surface areas and with one end held in place, be used to remove larger amounts of oils from the skin, whereby, a user may have the ability to control the amount of oil removed by providing different areas in each corner that can serve for oil removal purposes.

FIGS. 10A-10D depicts a left side elevational view, a right side elevational view, a bottom plan view, and a top plan view of the exemplary folium shaped sponge 110, respectively. The elevational views depict the folium shaped sponge 110 as having a volume based on the surfaces enclosing an area that may be made of foam material which may comprise an oil absorbent characteristic to remove excess oils from a skin surface without disrupting previously applied cosmetics. The volume created may facilitate the sponge being comprised of non-latex foam material with anti-microbial agents dispersed within. In one embodiment, the non-latex foam material making up the folium shaped sponge may effect the absorbing of oils on the skin surface through previously applied cosmetics. That is, as the skin produces the oils, the oils begin to build underneath a layer of applied cosmetic and the absorbent characteristics of the sponge help to remove excess oils by absorbing them through the layer of cosmetics, leaving the layer of cosmetics having been previously applied substantially intact.

It is contemplated that various combinations and/or subcombinations of the specific features and aspects of the above embodiments may be made and still fall within the scope of the invention. Accordingly, it should be understood that various features and aspects of the disclosed embodiments may be combined with or substituted for one another in order to form varying modes of the disclosed invention. Further it is intended that the scope of the present invention is herein disclosed by way of examples and should not be limited by the particular disclosed embodiments described above.

What is claimed is:

1. A device comprising:

a first folium shaped sponge wherein the first folium shaped sponge is made of foam material, and wherein the first folium shaped sponge comprises an oil absorbent characteristic to remove excess oils from a skin surface without disrupting previously applied cosmetics;

a second folium shaped sponge wherein the second folium shaped sponge is made of foam material, and wherein the second folium shaped sponge comprises an oil absorbent characteristic to remove excess oils from a skin surface without disrupting previously applied cosmetics;

a separator member configured to be placed between the first folium shaped sponge and the second folium shaped sponge; and a storage housing comprising a removable lid member and a vented base member, wherein the vented base member facilitates drying of the first folium shaped sponge after usage via providing a ventilated area, and wherein the storage housing is configured to receive and store the first folium shaped sponge.

2. The device of claim 1 wherein the storage housing is further configured to receive and store the second folium shaped sponge.

3. The device of claim 1 wherein the separator member is dimensioned to be inserted in the storage housing in a manner to fully space the first folium shaped sponge from the second folium shaped sponge.

4. The device of claim 1 wherein the separator member is constructed from transparent material.

5. The device of claim 1 wherein the removable lid member is detachably attached to the base member.

6. The device of claim 5 wherein the removable lid member is detachably attached to the base member via one or more hinges.

7. The device of claim 5 wherein the removable lid member comprises a reflective surface for reflecting a clear image.

8. The device of claim 1 wherein the base member comprises an inner wall and an outer wall, wherein the inner wall comprises a pair of concave shaped areas to fit a fingertip along an inner channel of the inner wall to lift the first folium shaped sponge.

9. The device of claim 1 wherein the first folium shaped sponge and the second folium shaped sponge are made of non-latex foam material.

10. The device of claim 9 wherein the first folium shaped sponge and the second folium shaped sponge are made of non-latex foam material, each comprising anti-microbial agents thereby inhibiting growth of bacteria inside both the first folium shaped sponge and the second folium shaped sponge.

11. The device of claim 1 wherein the first folium shaped sponge and the second folium shaped sponge each comprise a range of angles for application of the folium shaped sponge based on a contact angle between the folium shaped sponge and the skin surface.

12. The device of claim 1 wherein the first folium shaped sponge and the second folium shaped sponge are each configured to:

remove the excess oil through a pressing and lifting motion on the skin surface; and smooth out any remaining cosmetics on the skin surface via a pressing motion following the removal of excess oil via the pressing and lifting motion.

* * * * *